US006880282B1

(12) United States Patent
Olsen

(10) Patent No.: US 6,880,282 B1
(45) Date of Patent: Apr. 19, 2005

(54) LOCKABLE FIREARM SAFETY DEVICE

(75) Inventor: Charles A. Olsen, Milford, CT (US)

(73) Assignee: The Marlin Firearms Company, North Haven, CT (US)

( * ) Notice: Subject to any disclaimer, the term of this patent is extended or adjusted under 35 U.S.C. 154(b) by 0 days.

(21) Appl. No.: 10/702,707

(22) Filed: Nov. 6, 2003

Related U.S. Application Data

(63) Continuation of application No. 09/892,080, filed on Jun. 26, 2001, now Pat. No. 6,694,659.

(51) Int. Cl.[7] ..... F41A 17/42
(52) U.S. Cl. ..... 42/70.11; 211/64
(58) Field of Search ..... 42/70.11, 70.01

(56) References Cited

U.S. PATENT DOCUMENTS

| | | | | |
|---|---|---|---|---|
| 2,963,895 | A | 12/1960 | Thomas | |
| 3,774,333 | A | 11/1973 | Reynolds | 42/1 R |
| 3,802,612 | A | 4/1974 | Smith | 224/1 R |
| 3,999,409 | A | 12/1976 | Bell | |
| 4,300,190 | A | 11/1981 | Mershon | |
| 4,364,499 | A | 12/1982 | McCue | 224/42.45 R |
| 4,624,372 | A | 11/1986 | Brolin | 211/4 |
| 4,696,405 | A | 9/1987 | Waring | 211/4 |
| 4,747,280 | A | 5/1988 | Shaw | 70/279 |
| 4,929,004 | A | 5/1990 | Chidester | |
| 5,020,259 | A | 6/1991 | Mossberg | 42/70.11 |
| 5,076,531 | A | 12/1991 | Delaney | |
| 5,122,932 | A | 6/1992 | Ziller | |
| 5,153,360 | A | 10/1992 | Upton | 42/70.11 |
| D341,072 | S | 11/1993 | Bryant | |
| 5,400,538 | A | 3/1995 | Shannon | 42/70.07 |
| 5,438,787 | A | 8/1995 | McMaster et al. | 42/106 |
| 5,446,988 | A | 9/1995 | Frederick, Jr. | 42/70.11 |
| 5,524,772 | A | 6/1996 | Simmons | 211/4 |
| 5,551,181 | A | 9/1996 | Upton | 42/70.11 |
| 5,560,576 | A | 10/1996 | Cargill | |
| 5,676,257 | A | 10/1997 | Adkins | 211/4 |
| 5,680,723 | A | 10/1997 | Ruiz | 42/70.11 |
| 6,052,934 | A | 4/2000 | Carpenter | |
| 6,142,313 | A | 11/2000 | Young | 211/4 |
| D455,915 | S * | 4/2002 | Noble | D6/466 |
| 6,382,002 | B1 | 5/2002 | Chen | 70/202 |
| 6,568,117 | B1 | 5/2003 | Weinraub | 42/70.11 |
| 6,684,929 | B1 | 2/2004 | McDonald et al. | |
| 2002/0020584 | A1 | 2/2002 | Cjepa | |
| 2004/0025394 | A1 | 2/2004 | Young | |

FOREIGN PATENT DOCUMENTS

| | | |
|---|---|---|
| DE | 3836361 A1 | 5/1990 |
| GB | 2170994 A | 8/1986 |

* cited by examiner

*Primary Examiner*—Michael J. Carone
*Assistant Examiner*—Troy Chambers
(74) *Attorney, Agent, or Firm*—Alix, Yale & Ristas, LLP

(57) ABSTRACT

A lockable safety device for use with a firearm. The device comprises a clamp or bracket that is engageable with a locking bar. When the clamp and locking bar are engaged with a firearm, access to, and use of, the firearm is restricted. The clamp can comprise a third arm projecting therefrom to prevent complete cycling of the firearm action.

20 Claims, 10 Drawing Sheets

92

12
34
90
94
38
124
96
36

A
B
98
94
80
90
96
100

12
94
96
124
38
92
100
98

LOCKABLE FIREARM SAFETY DEVICE

RELATED APPLICATIONS

This application is a continuation of U.S. application Ser. No. 09/892,080, filed Jun. 26, 2001, now U.S. Pat. No. 6,694,659, the contents of which are incorporated herein by reference in their entirety.

BACKGROUND OF THE INVENTION

This invention relates generally to safety devices that are separate from, but securable to, a firearm to prevent discharge of the firearm by unauthorized users.

The use of separable locks and other locking mechanisms, including electronic devices, to prevent discharge of a firearm by unauthorized persons is commonplace and a wide variety of devices and techniques have been advanced. The majority of such devices either interfere with the trigger or firing mechanism to prevent discharge of the firearm by an unauthorized user. These devices generally are not directed to preventing loading or unloading of ammunition or disassembly of the firearm on which they are used.

Cable type firearm locking devices are also known. Such devices require a user to thread a cable into a first aperture in the firearm receiver, through the receiver to a connected second aperture and out of the receiver through the second aperture to render the firearm incapable of discharge. Naturally, this type of locking device cannot be used with firearms of the type having only one aperture or with firearms of the type having an action that prevents threading the cable through the receiver from the first aperture to the second aperture. Additionally, the known cable type locking devices are disadvantageous in that they do not prevent access to restricted areas of the firearm receiver.

SUMMARY OF THE INVENTION

Briefly stated, the invention in a preferred form is a safety device for a firearm. The safety device clamps around and encircles the firearm. The inventive device is robust in construction, yet owing to simplicity of design it can be produced economically. In some embodiments the safety device includes provisions for use with known locking devices to releasably secure the safety device to the firearm.

In one embodiment, the safety device comprises a base with legs projecting therefrom to form a generally "C" shaped clamp having one open side. The shape of the clamp is adapted to fit around three sides of a firearm receiver. A locking bat is releasably engageable with the projecting legs to enclose the open side of the clamp, thereby completely encircling the firearm receiver. The bar can be secured to the clamp by the use of a conventional locking device.

In another embodiment, the "C" shaped clamp includes a tab attached to the base. The tab is advantageously positioned between the legs and projects in the same direction as the legs. When the clamp is positioned around the receiver, the tab is adapted to interfere with cycling of a firearm action or, alternately, to be disposed within an opened firearm action. Placement of the tab in the firearm action prevents the action from completely cycling. Thus, the clamp can be engaged to the firearm with the tab disposed therein to prevent discharge and the locking bar can be selectively engaged to the clamp to prevent removal of the clamp from the firearm. Securing the locking bar to the clamp with a locking device prevents unauthorized discharge of the firearm.

In a further embodiment, the safety device comprises a base and a projecting arm to form an "L" shaped clamp. A tab optionally projects from the base. The tab is adapted to interfere with cycling of a firearm action. Alternatively, the tab is adapted to be disposed within an opened firearm action. The locking bar is also "L" shaped to selectively engage with the clamp. The engagement of the clamp with the locking bar is adapted to allow only one mode of disengagement of the locking bar from the clamp. Thus, the clamp can be engaged to the firearm to prevent discharge and the locking bar can be selectively engaged to the clamp to prevent removal of the clamp from the firearm. Securing the locking bar to the clamp with a locking device prevents unauthorized discharge of the firearm.

In a further embodiment, the firearm safety device is adapted to prevent access to restricted areas of the firearm when secured thereto. The adaptation advantageously comprises clamp and locking bar profiles that are shaped to cover areas of the firearm when the clamp and locking bar are secured around the firearm. In other embodiments, the firearm safety device comprises one or more wings or extensions that are shaped to cover restricted areas of the firearm when the clamp and locking bar are secured around the firearm.

In yet another embodiment, the clamp includes multiple tabs. When the clamp is positioned around the receiver, each tab is disposed within an opening in the firearm, thus preventing operation of the firearm action as well as insertion or removal of ammunition from the firearm.

In still another embodiment of the invention, the safety device is comprised of a base having a projecting tab and a flexible cable or strap selectively connectable to the base. When the base is positioned adjacent the receiver, the tab is disposed within an opened firearm action. The flexible cable or strap substantially encircles the firearm and connects to the base, securing the base to the firearm and preventing cycling or discharge of the firearm.

An object of the invention is to provide a new and improved separable lockable safety device for a firearm.

Another object of the invention is to provide a new and improved firearm safety device that has an efficient construction and can be efficiently installed and locked to provide a reliable safety device.

BRIEF DESCRIPTION OF THE DRAWINGS

Other objects and advantages of the invention will become apparent from the specification and the drawings in which.

DETAILED DESCRIPTION OF THE PREFERRED EMBODIMENTS

Figure 2:
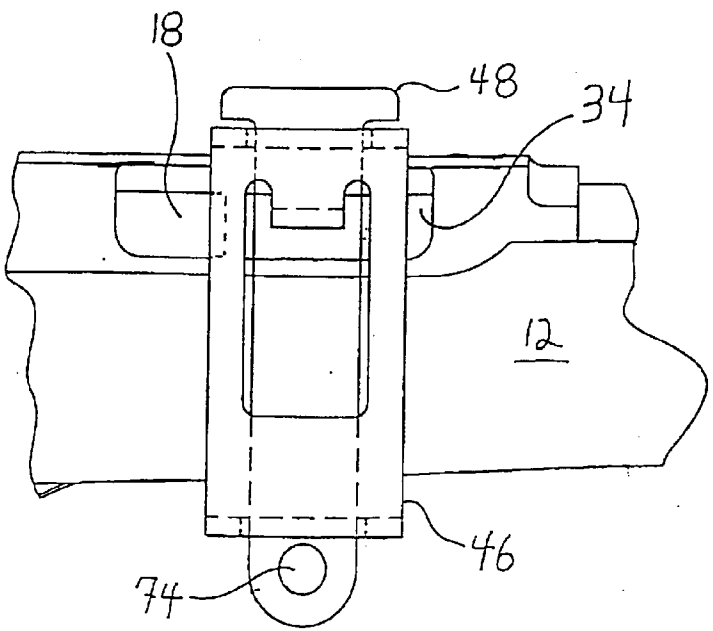
FIG. 2 is a side view of the firearm safety device of FIG. 1, partly in phantom, positioned around a firearm receiver (shown broken away)

It should be understood that while the inventive firearm safety device is shown and described in some of the figures with relation to a rifle having a lever type action for clarity, the invention has application with all types of firearms, including rifles, shotguns and pistols, and all types of firearm actions, including automatic, semiautomatic, pump, bolt, single shot, superposed and side by side types. With reference to the drawings wherein like numerals represent like parts throughout the several figures, as shown best in FIG. 16, a firearm 10 typically comprises a receiver or frame 12 to which a barrel 14 is mounted. The receiver 12 includes an action or mechanism 16 that must be completely cycled for the firearm to be discharged. Typically, the action cycle comprises firing a loaded cartridge, extracting the fired cartridge from the chamber, ejection of the fired cartridge from the firearm, loading an unfired cartridge from an integral or separable magazine into the chamber, and securing the unfired cartridge within the chamber, as with a breech block 18. As used herein, a breech block encompasses any part of a firearm mechanism for closing the rear of a chamber against the force of a discharging cartridge and includes breech bolts and breech faces.

The receiver 12 defines a firearm longitudinal axis that is generally parallel to the barrel 14. A trigger guard assembly 20 includes a trigger guard 22 for a trigger 24. The trigger guard assembly 20 is mounted to the underside of the receiver 12 in line with the firearm longitudinal axis. The trigger 24 is pivotally mounted to the receiver 12 or trigger guard 22 and substantially disposed within the trigger guard 22 when the firearm is in condition to be discharged. The trigger 24 is pulled rearward in a conventional fashion to actuate the firing mechanism and discharge the firearm.

The action 16 may employ a pivoting hammer 28 that cooperates with a firing pin (not shown), a striker assembly (not shown), or other well-known firing mechanisms. For simplicity, the invention will be described in relation to a firing mechanism using a hammer. Actuation of the trigger 24 functions to release the hammer 28 to strike the firing pin and propel the firing pin into contact with the primer of a cartridge housed within the chamber. Contact of the pin with the primer generates sufficient energy to explode a primer mixture and ignite a propellant mixture within the cartridge. Combustion of the propellant mixture generates sufficient pressure to discharge a bullet from the barrel 14.

Figures 9, 10, 11, 12:
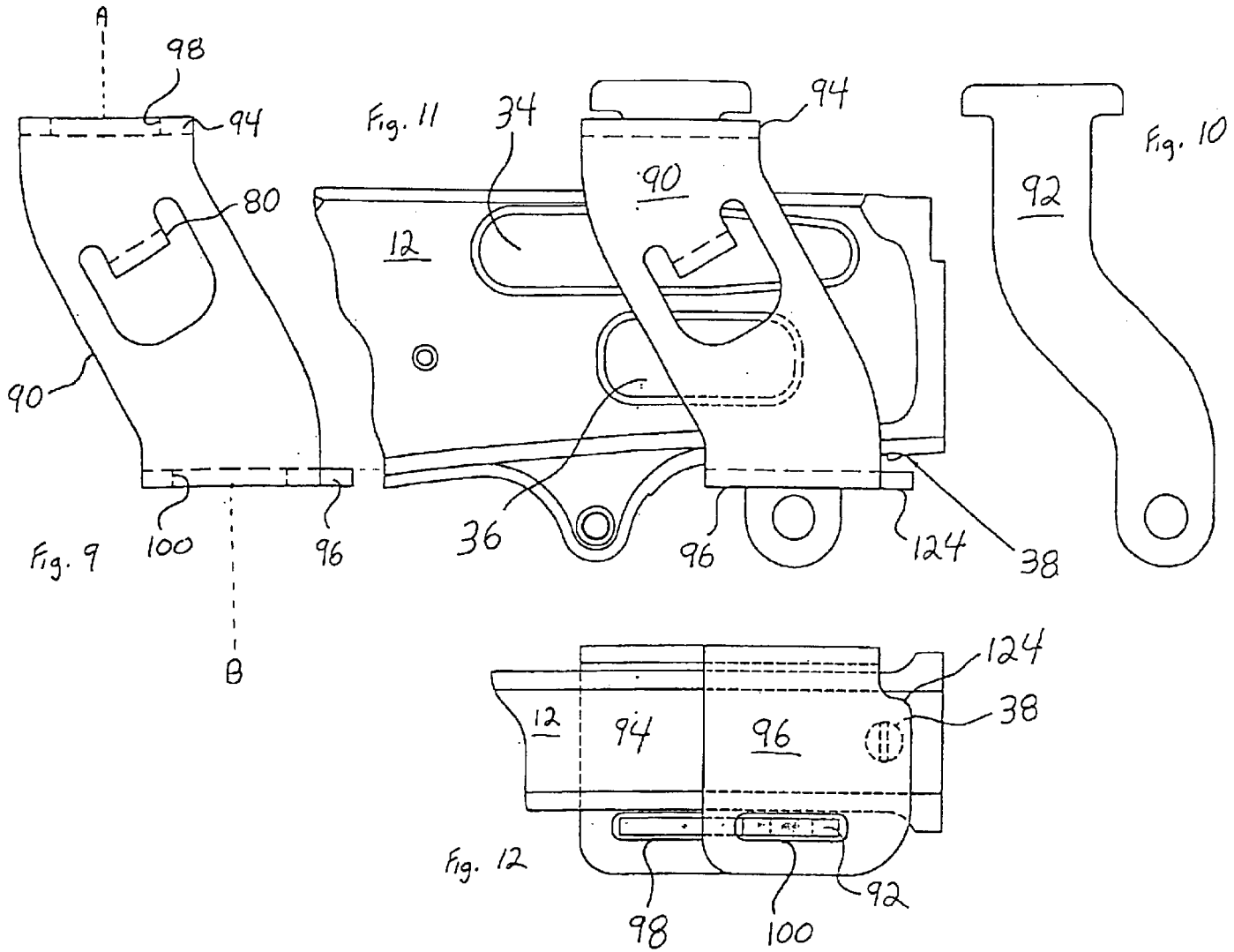
FIG. 9 is a side view, partly in phantom, of an alternative embodiment of a firearm safety device clamp.
FIG. 10 is a side view of a locking bar for the firearm safety device of FIG. 9.
FIG. 11 is a side view, partly in phantom, of the firearm safety device bar and clamp illustrated in FIGS. 9 and 10 encircling a firearm receiver (partly in phantom)
FIG. 12 is a bottom view, partly in phantom, of the firearm safety device and receiver of FIG. 11.
Figure 15:
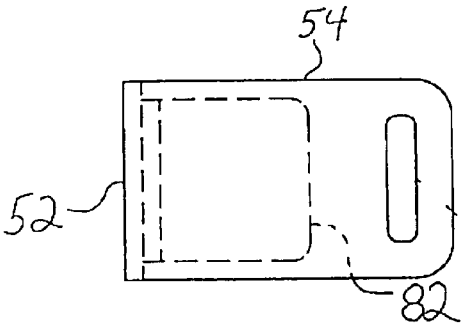
FIG. 15 is a top view, partly in phantom, of the firearm safety device clamp illustrated in FIG. 13.
Figure 22:
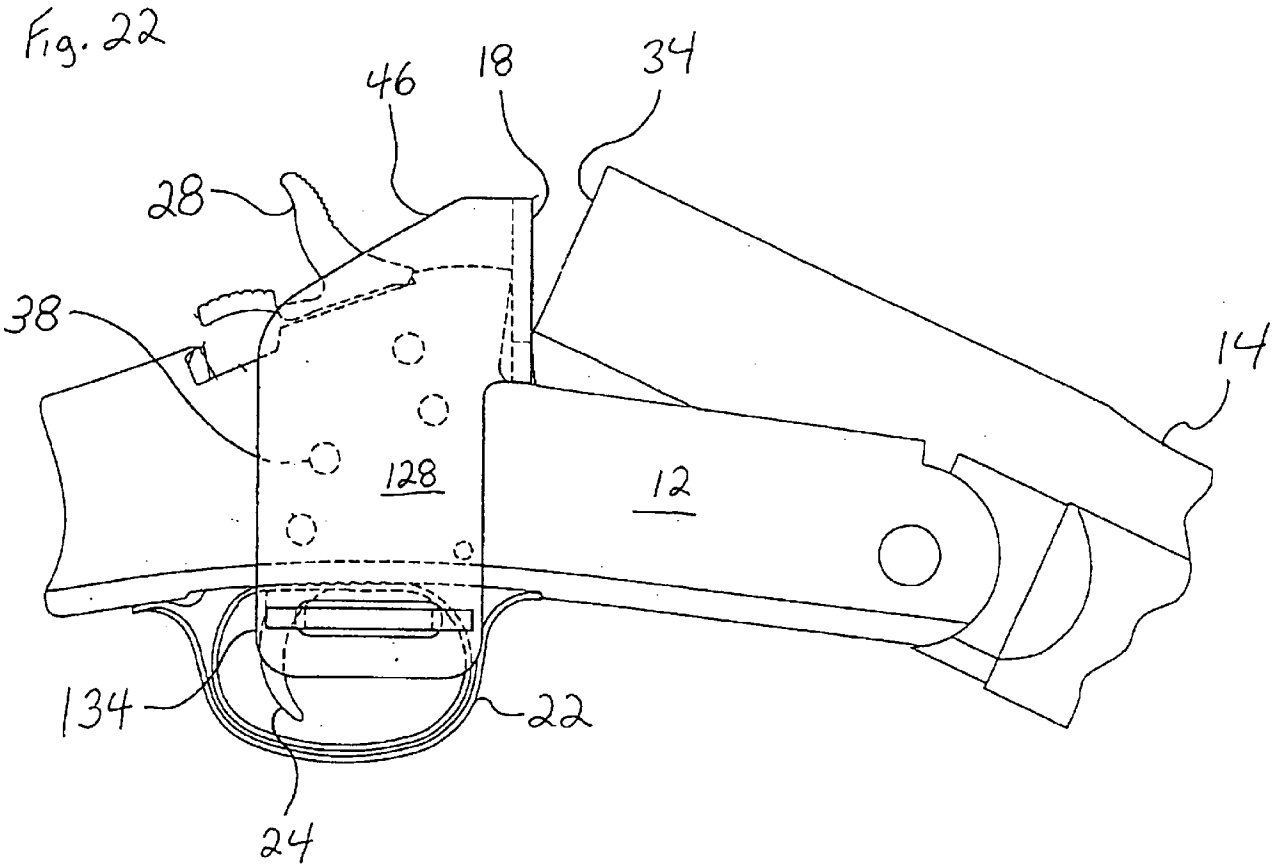
FIG. 22 is a is a side view of the firearm safety device of FIG. 19 secured to a firearm, shown broken away.

As shown best in FIG. 11, the receiver 12 defines an ejection port 34 for ejection of a fired cartridge and a loading port 36 for loading ammunition into the firearm. As is known in the art, the ejection and loading ports 34, 36 may be defined in different positions in the receiver 12. For example, loading and ejection ports 34, 36 may each be located at any of the top, bottom and/or sides of the receiver 12. In some firearm applications, the loading and ejection ports may be defined at the same position on the receiver. In some firearm types, the loading port will be a magazine well (not shown) for use with a separable magazine. In revolver type firearms (not shown) the loading and ejection ports will be the rear of the cylinder. In break open type firearms as shown in FIG. 22 such as, for example, superposed shotguns the loading and ejection ports will be the rear of the barrel assembly. The receiver 12 also includes a number of pins, screws, bolts or other fasteners such as represented by 38, that are used to secure the various mechanisms of the firearm 10 to the receiver 12. Removal of these fasteners 38 is typically required to disassemble the firearm 10 into components.

Figure 1:
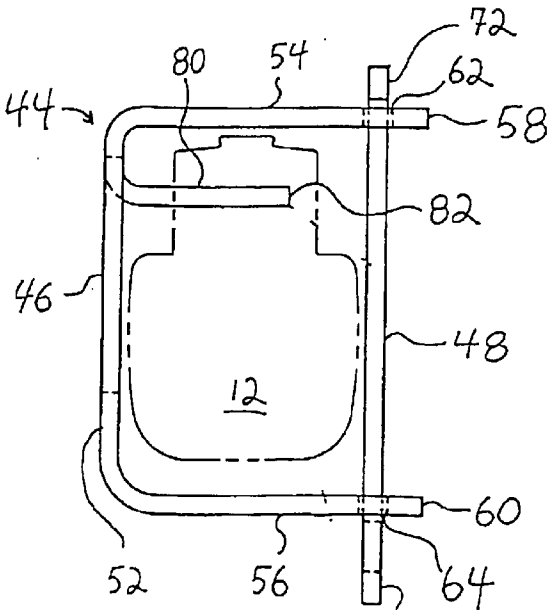
FIG. 1 is a front view of a firearm safety device, partly in phantom, positioned around a firearm receiver (shown in outline)
Figure 5:
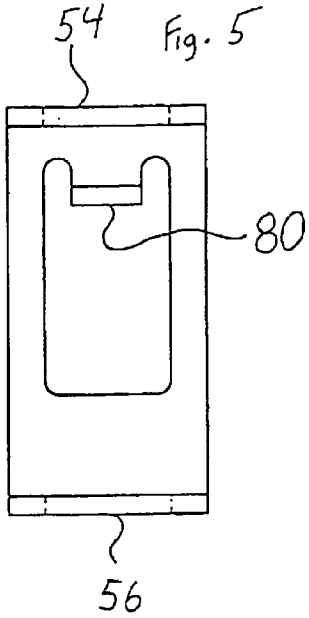
FIG. 5 is a side view facing the clamp legs and partly in phantom of the firearm safety device clamp of FIG. 1.
Figure 6:
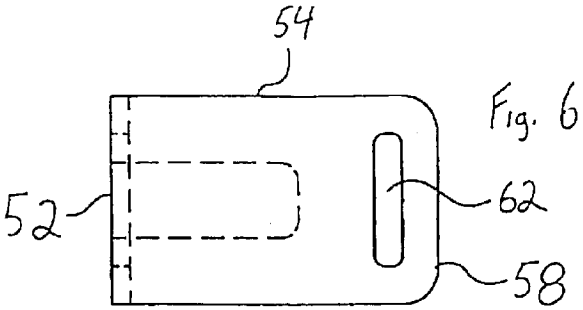
FIG. 6 is a top view, partly in phantom, of a firearm safety device clamp of FIG. 1.
Figure 4:
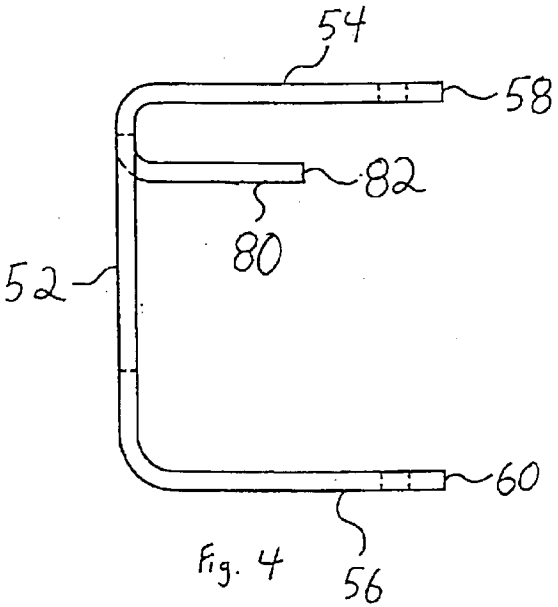
FIG. 4 is a front view, partly in phantom, of the firearm safety device clamp of FIG. 1.
Figure 8:
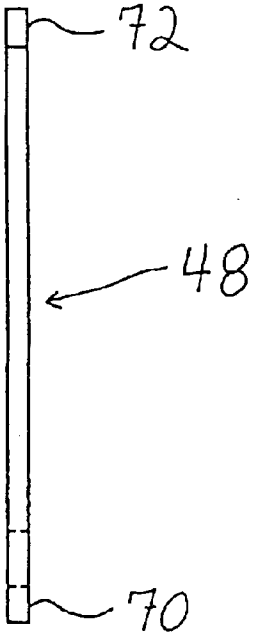
FIG. 8 is a front view of a firearm safety device locking bar of FIG. 1.

With reference to the embodiment illustrated in FIG. 1, the inventive firearm safety device 44 comprises a clamp 46 selectively engageable with a locking bar 48. The clamp 46 includes a base 52 and two arms 54, 56 attached thereto. Each of the arms 54, 56 has a free end (58, 60 respectively) projecting substantially orthogonally from the base 52 and in the same direction, so that the base 52 and arms 54, 56 define a general "C" shape. The free end portion of each arm 58, 60 defines an aperture (62, 64 respectively) therein. The arm apertures 62, 64 (62 shown in FIG. 3) may have a slotted shape. The centerlines of arms 54 and 56 are aligned with each other and generally orthogonal to the firearm longitudinal axis in this embodiment.

The arms 54, 56 are typically rigid and permanently attached to the base 52, such as, for example, by forming the arms 54, 56 and base 52 as a single, integral metal stamping. As used herein, a rigid arm is not capable of folding or appreciably bending under normal user manipulation. The rigid arms and attachment allow very little movement of the arms with respect to the base. It is desirable in some applications to attach at least one of the arms to the base using a flexible connector (not shown) such as, for example, a hinge. A flexible connector allows the flexibly connected arm to be radially displaced with respect to the base. Flexibly connecting at least one arm to the base enhances the ease with which the clamp can be positioned over a receiver. Since the clamp is easier to position over the receiver, the arms can be shaped to more closely approximate the receiver exterior shape, minimizing installed clamp movement on the receiver. Further, many enthusiasts do not want to degrade the exterior finish of a firearm and use of a flexible connection between the base and at least one arm minimizes the chance of scratching or scuffing the firearm exterior finish. Naturally, the use of a flexible connector between the base and the arm increases manufacturing complexity of the inventive safety device.

Figure 16:
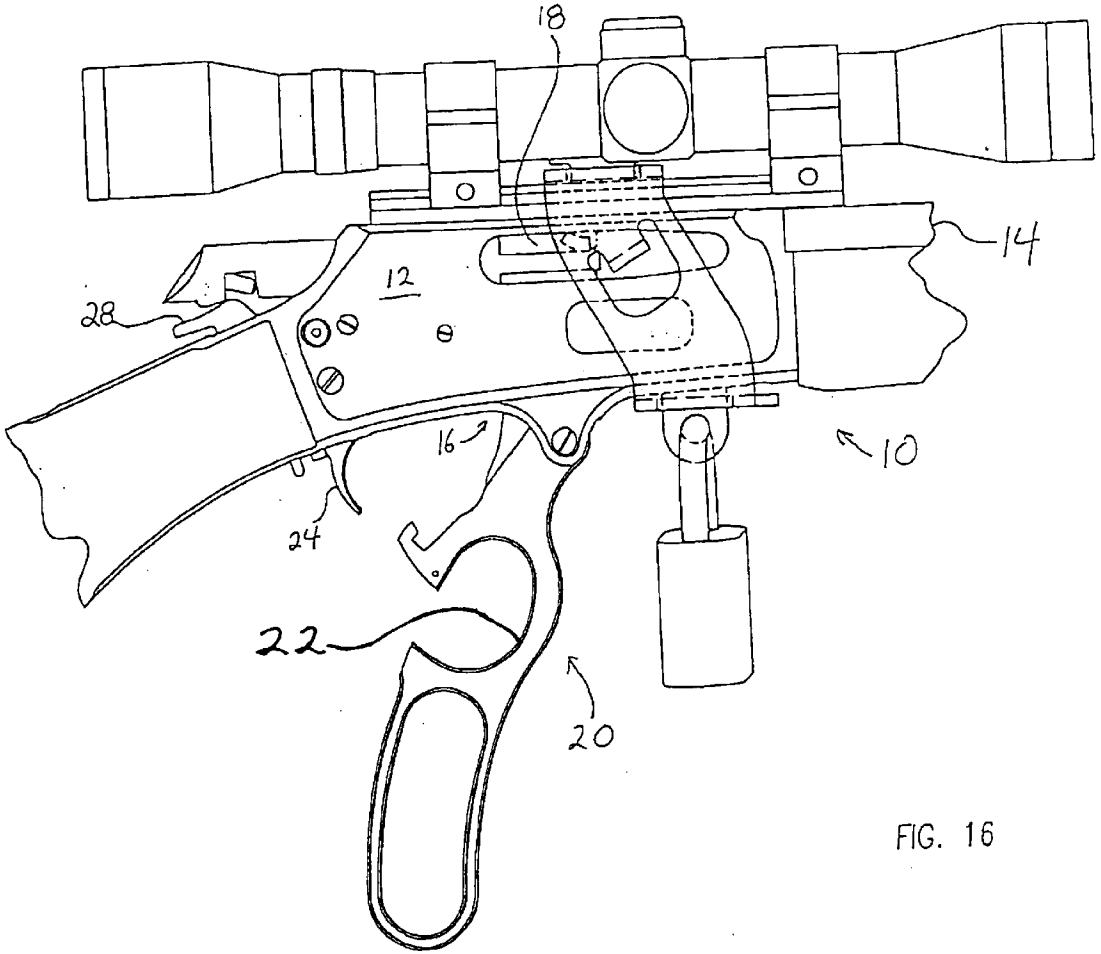
FIG. 16 is a side view of an embodiment of a firearm safety device clamp and bar secured to a firearm, shown broken away, by a conventional locking device.

The locking bar 48 includes a first end 70 configured for insertion through both of the arm apertures 62, 64 and a spaced second end 72 configured to prevent insertion or movement through either arm aperture 62 or 64. The locking bar first end 70 defines an aperture 74 configured to accommodate a conventional locking device, for example, a shackle of a conventional lock as shown in FIG. 16. In this embodiment the locking bar may be rigid. As used herein, a rigid locking bar is not capable of folding or appreciably bending under the normal manipulation of a user. In other aspects of the invention the locking bar may be a flexible member such as, for example a strap, wire or cable.

Typically, the clamp 46 and locking bar 48 are comprised of metal. Other materials such as, for example, plastic can be used if the strength and security of a metal safety device 44 is not needed or desired. The clamp 46 and locking bar 48 can be covered with a protective coating, for example plastic or elastomer, to lessen or prevent scratching of the firearm finish.

Figure 3:
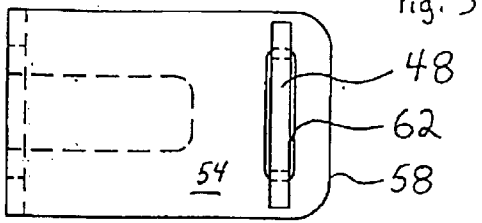
FIG. 3 is the top view, partly in phantom, of the firearm safety device of FIG. 1 showing a clamp engaged with a firearm safety device bar.

With reference to FIGS. 1–3, during use, any ammunition within the firearm chamber is removed and the clamp 46 is positioned over the firearm receiver 12. The locking bar first end 70 is sequentially inserted through both arm apertures 62, 64, as shown in FIGS. 1 and 2. The configuration of the second end 72 prevents movement of the locking bar 48 completely through the arm apertures 62, 64 in the insertion direction. Thus, the locking bar 48 can only be withdrawn from the apertures 62, 64 in a removal direction. The shackle of a locking device is inserted through the locking bar aperture 74 preventing movement of the engaged locking bar 48 through the arm apertures 62, 64 in the removal direction, thereby releasably securing the locking bar 48 to the clamp 46 and the assembled safety device 44 to the firearm 10. Naturally, it would also be possible to sequentially insert the locking bar through arm apertures 64 and 62, reversing the insertion direction, removal direction and engaged position of the locking bar with respect to the clamp. When secured, the safety device 44 interferes with manipulation of the firearm trigger 24 and/or components of the firearm action 16. For example, the inventive safety device can be configured to prevent complete actuation of the lever of a lever action firearm when engaged to the firearm. Since complete cycling of the action is necessary for firearm use, the secured safety device prevents unauthorized users from discharging the firearm. Similarly, the inventive safety device can be configured to prevent complete actuation or cycling of necessary components on other firearm types, such as, for example, complete opening or closing of the breech block.

A person of ordinary skill in the art can envision other ways in which the locking bar can engage the clamp to secure the clamp around a firearm receiver. As one example, the locking bar first end defines an aperture and a second clamp arm free end is configured to fit within the aperture. In this embodiment the locking bar is inserted through the clamp first arm aperture as previously described. The second clamp arm free end is positioned within the locking bar aperture. A locking device is selectively engageable with the second clamp arm free end projecting beyond the locking bar aperture in a manner similar to that previously described to maintain the locking bar in engagement thereto.

Figure 13:
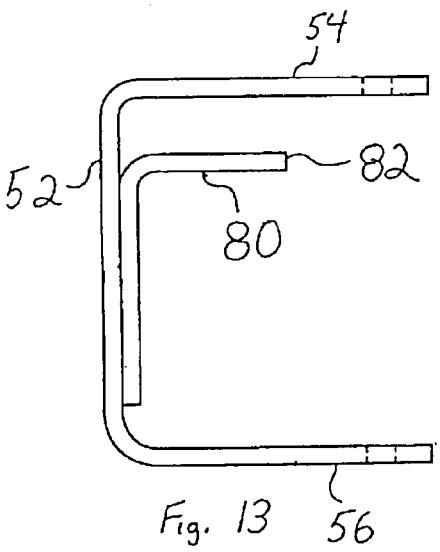
FIG. 13 is a front view, partly in phantom, of another embodiment of a firearm safety device clamp.
Figure 14:
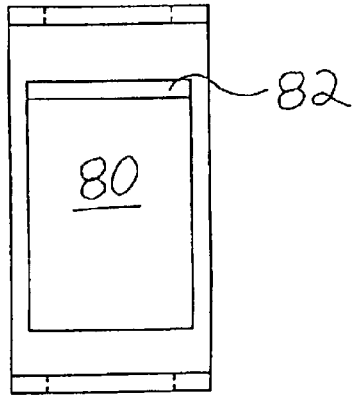
FIG. 14 is a side view facing the clamp legs and partly in phantom of the firearm safety device clamp illustrated in FIG. 13.

With reference to FIGS. 1–3, in another aspect of the invention the clamp 46 advantageously includes a tab 80 projecting from or attached to the base 52. A free end 82 of the tab 80 projects from the base 52 in the same direction as the arms 54, 56. The tab 80 may be integrally formed and bent from the same piece of material as the base 52. An integral tab results in lower material cost and less part complexity and eliminates the need for a separate manufacturing step to attach the tab to the base. Alternatively, the tab 80 may be a separate component attached to the base 52 as shown in FIG. 13. With reference again to FIGS. 1–3, the tab 80 is shaped and disposed on the base 52 such that when the clamp 46 is positioned on the firearm receiver 12, the tab free end 82 will be disposed within ah opened port. Placement of the tab free end 82 within an ejection port 34 as shown in FIG. 2 interferes with complete cycling of the firearm action 16, for example by preventing the complete opening or closing of a breech bolt 18.

In use, the firearm action 16 is partially cycled to move the breach bolt 18 away from the chamber, unload a cartridge from the chamber and open the ejection port 34. The clamp 46 is placed around the firearm receiver 12 as shown in FIGS. 1 and 2 so that the tab free end 82 is disposed within the open ejection port 34. The locking bar first end 70 is inserted through both arm apertures 62, 64 until the locking bar aperture 74 extends beyond the last arm 56. A locking device is secured to the locking bar aperture 74. In the secured condition, the lock prevents removal of the locking bar 48 from the safety device 44; the locking bar 48 prevents removal of the safety device 44 from the firearm 10; the safety device tab 80 prevents complete cycling of the breach bolt 18 and thereby prevents discharge of the firearm. Since the firearm action 16 cannot be fully cycled, removal of ammunition contained within the firearm magazine can also be prevented.

Figure 7:
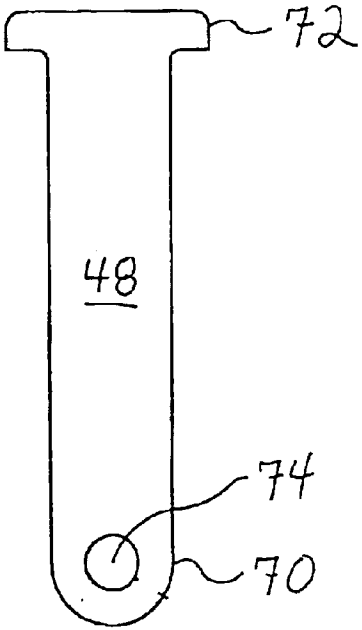
FIG. 7 is a side view of the firearm safety device locking bar of FIG. 1.

The clamp base, clamp arms and locking bar can be shaped to accommodate different types of firearms and firearm actions. For example, in the embodiment shown in FIGS. 9–12, the base 90 (shown separately in FIG. 9) and the locking bar 92 (shown separately in FIG. 10) each have a planar, compound curved shape. As shown in FIG. 9, the planar, compound curved shape of the base 90 offsets a centerline A of one arm 94 in relation to a centerline B of the other arm 96. Both centerlines A, B are offset from a centerline of the base 90. Centerlines A and B remain generally orthogonal to the firearm longitudinal axis in this embodiment. This shaped arrangement allows the safety device to be placed over a receiver 12 and secured thereto with the tab free end disposed in the ejection port 34 and preventing complete cycling of the breech bolt. The shaped arrangement additionally covers the firearm loading port 36, preventing insertion of ammunition into the firearm 10. Note, that if the upper or lower arm were rotated with respect to the base 90, the centerlines and apertures in the upper and lower arms 98, 100 respectively would be aligned, allowing the use of the linear locking bar 48 shown in FIG. 7, while still restricting access to the loading port 36. Naturally, other inventive clamp and locking bar shapes can be used to restrict access to different areas on a firearm, for example, loading ports, ejection ports, trigger, safety, fasteners, on different types of firearms.

Figure 18:
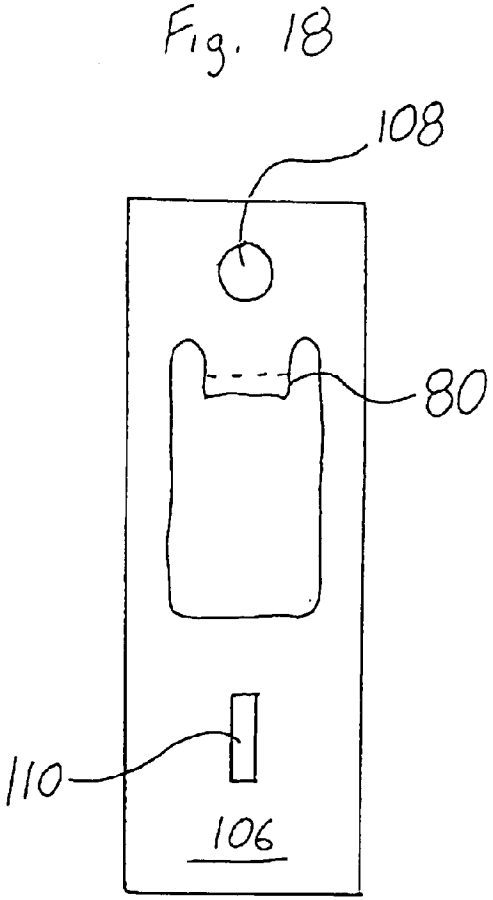
FIG. 18 is a side view of the base of the firearm safety device of FIG. 17.
Figure 17:
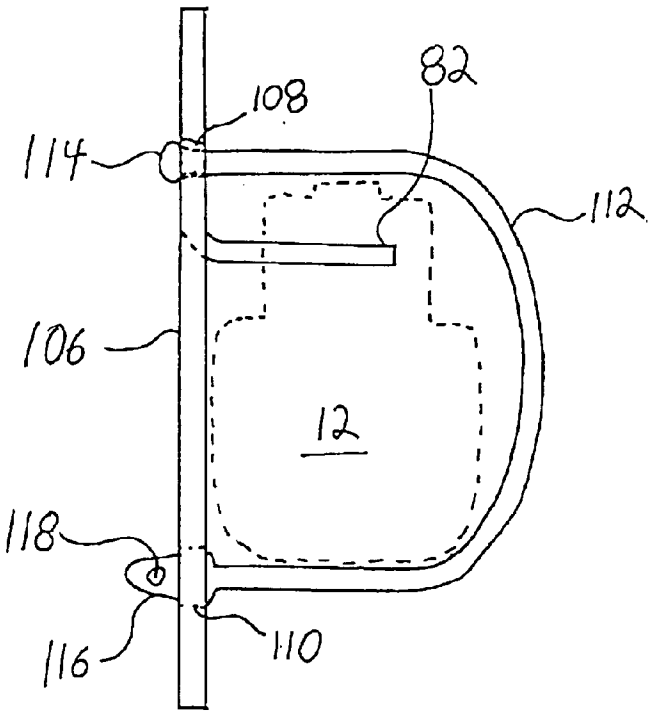
FIG. 17 is a front view, partly in phantom, of another embodiment of a firearm safety device.
Figure 21:
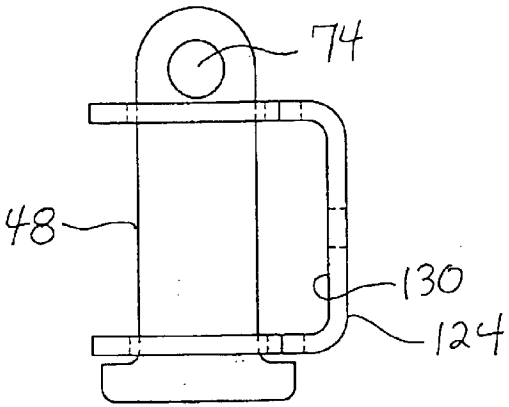
FIG. 21 is a top view, partly in phantom, of the firearm safety device of FIG. 19.
Figure 20:
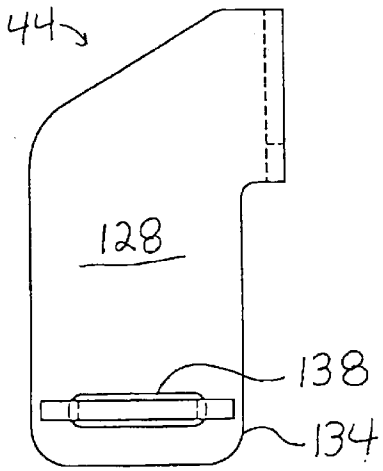
FIG. 20 is a side view, partly in phantom, of the firearm safety device of FIG. 19.
Figure 19:
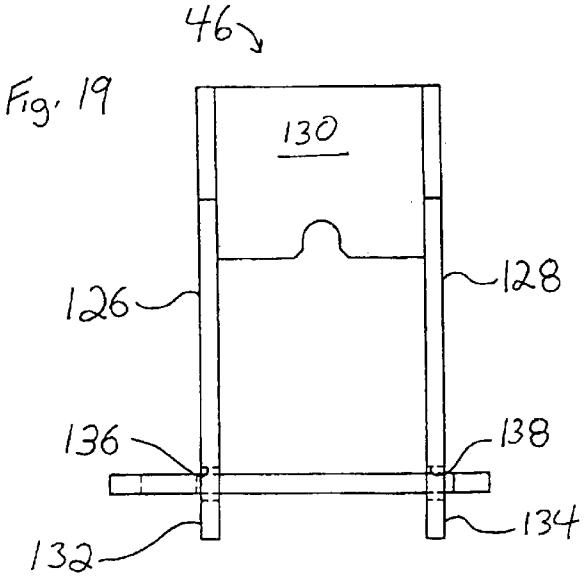
FIG. 19 is a rear view of another embodiment of a firearm safety device showing a clamp engaged to a bar.

In another embodiment shown in FIGS. 17 and 18, the tab free end 82 projects from a base 106 defining two spaced securing apertures 108, 110. A flexible member 112 such as a strap, wire or cable is insertable through the securing apertures 108, 110. Flexibility as used herein refers to the property of the flexible member to be readily rolled or folded by a user under normal manipulation. A jam end 114 of the member 112 is enlarged to prevent movement through the securing apertures 108, 110. The jam end 114 can also be permanently mounted to the base 106. A locking end 116 of the flexible member 112 is adapted to permit insertion through the securing apertures 108, 110. The locking end 116 defines an aperture 118 to allow securing of a locking device thereto.

In use, the firearm 10 is partially cycled to open the ejection port 34. The base 106 is placed adjacent the receiver 12 so that the tab free end 82 is disposed within the port 34. The locking end 116 is inserted through one of the securing apertures 108, 110, looped around the exterior of firearm 10, and inserted through the other of the apertures 108, 110 to secure the base 106 to the firearm 10. A locking device is secured to the lock end aperture 118 to selectively fix the firearm safety device 44 to the firearm 10, thereby preventing actuation of the firearm action 16 and discharge of the firearm 10. It would also be possible to incorporate the locking device into the base. This embodiment solves a problem present in known cable-type firearm locking devices, which are difficult or impossible to thread internally through certain firearm types. The inventive safety device does not require the flexible member to pass internally through the firearm, solving the above deficiency.

In still another embodiment shown in FIGS. 19–23 the clamp 46 comprises a base 124. First and second arms, 126 and 128 respectively, project substantially orthogonally from a face 130 of the base 124. Each arm 126, 128 includes terminal portions 132, 134 that can be substantially parallel to the face 130. As can be seen best from FIG. 20, centerlines for each of the arms 126, 128 would be aligned and each arm centerline would be offset from a centerline of the base 124. Each terminal portion 132, 134 defines an aperture, 136 and 138 respectively, therein. The locking bar 48 is sequentially insertable within the apertures 136, 138.

Figure 23:
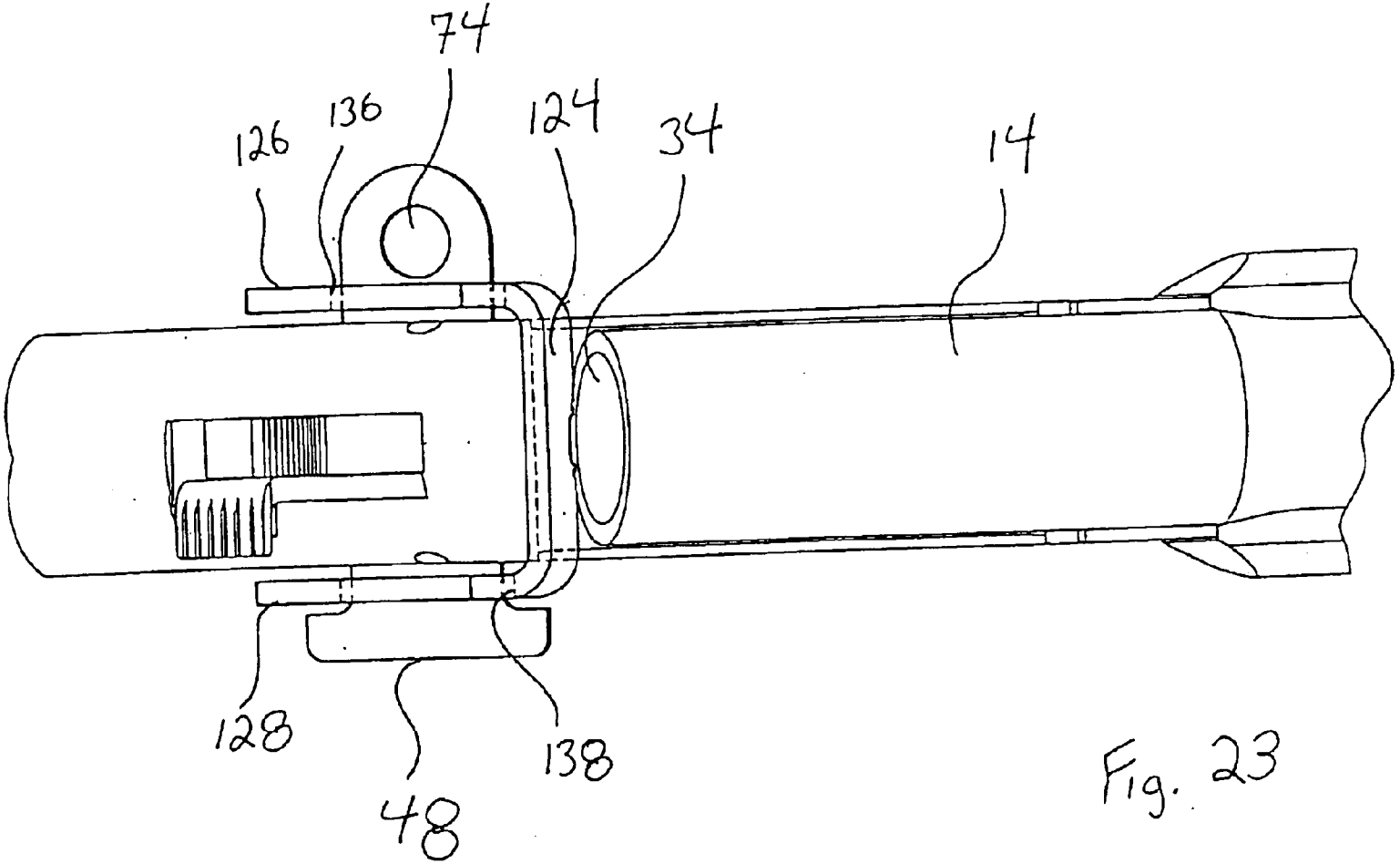
FIG. 23 is a top view of the firearm safety device of FIG. 19 secured to a firearm, shown broken away.

As shown in FIGS. 22 and 23, in use, the firearm is partially cycled to open the ejection port 34. The base 124 is disposed between the breech face 18 and the ejection port 34, preventing closing of the firearm action. The locking bar 48 is sequentially inserted through the apertures 136, 138 to prevent removal of the clamp 46 from the firearm. In the variation shown the locking bar 48 passes through the trigger guard 22 preventing removal of the safety device 44 from the firearm. A locking device is secured to the lock bar aperture 74 to selectively fix the firearm safety device 44 to the firearm, thereby preventing actuation of the firearm action and discharge of the firearm. At least one arm 126, 128 can be configured to prevent access to restricted areas of the firearm such as loading ports, ejection ports, fasteners, safeties, bolt, trigger or any other area. FIG. 22 illustrates arm 128 restricting access to fasteners 38, preventing disassembly of the firearm. In other variations the clamp can be configured to maintain the barrel in a closed relationship to the breech face to prevent loading and use of the firearm or the clamp can be configured to restrict movement of the trigger to prevent discharge of the firearm.

In any embodiment, the clamp and/or locking bar are shaped and/or sized to provide sufficient clearance to allow ease of positioning over a selected firearm. The clearance between the assembled safety device 44 and the encircled firearm 10 should not be sufficient to allow removal of the safety device 44 or movement of the tab 80 out of the ejection port 34. As previously discussed, use of a flexible connection between the base and at least one arm is beneficial in some embodiments to ease positioning of the safety device 44 over the firearm. The clamp can also include provisions such as apertures or mounting points (not shown) to fasten the clamp to a surface such as, for example, a vehicle mounting bracket or a locker wall. Engagement of the firearm within the fastened clamp and securement of the locking bar with the clamp not only prevents full cycling of the firearm action but also immobilizes the firearm to that surface. In this fashion portability of the firearm is greatly reduced.

In any embodiment the clamp and/or locking bar can include "extensions" or "wings" to prevent access to restricted areas of the firearm such as loading ports, ejection ports, fasteners, safeties, bolt, trigger or any other area. By restricting access to selected areas of the firearm, loading and unloading of ammunition as well as disassembly of the firearm can be prevented. FIGS. 11 and 12 illustrate an embodiment of the invention wherein one arm 96 includes an extension 124 to prevent access to a fastener 38 in the firearm receiver 12.

The clamp may include an additional tab (not shown) configured to interact and fit within a loading port or magazine well in addition to the tab configured for disposition within the ejection port. For example, a firearm can be of the type having a loading port in the bottom of the receiver and an ejection port in the side of the receiver. When the dual tabbed clamp is placed over the receiver, one tab will be disposed within each of the ports. Securing the clamp to the firearm with the locking bar prevents not only cycling of the action but insertion or removal of ammunition through the loading port. As shown in FIG. 16, the inventive safety device can be configured to allow usage with firearms having attached optical sighting devices.

The use of a conventional locking device is advantageous in that it permits a user to secure firearms with existing locks, thereby lowering the cost of the safety device. Additionally, the use of a conventional locking device with the inventive safety device allows a user the choice of securing the firearm with conventional mechanical key locks, conventional mechanical combination locks, magnetic or electronic key locks, electronic combination locks, etc. Further, the locking device can easily be changed. A plurality of inventive devices can also easily be secured with a respective plurality of locking devices, each locking device responsive to the same key or combination.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A safety device for a firearm having a breech block, comprising:

a clamp including a base having first and second end portions, a first arm mounted to and projecting from the first end portion, a second arm mounted to and projecting from the second end portion;

a clamp closure that is manually separable from the clamp and having first and second ends, the clamp closure first end selectively engageable in a sequential fashion with one of the first or second arms and then with the other of the first or second arms; and wherein a portion of the base interferes with full cycling of the breech block when the safety device is engaged to the firearm so that the firearm cannot be discharged.

2. The device of claim 1, wherein the base portion comprises a third arm mounted to and projecting from the base.

3. The device of claim 1, wherein the base portion comprises a third arm rigidly mounted to the base between the first and second arms, the third arm projecting from the base in a direction generally similar to the first and second arms, wherein the third arm is disposed within a loading port or an ejection port when the clamp is engaged to the firearm.

4. The device of claim 1, wherein the base defines an aperture therein having an edge and the base portion comprises an arm attached to the base at the edge.

5. The device of claim 1, wherein the base portion comprises an arm bent from material of the base to form a corresponding aperture in the base.

6. The device of claim 1, wherein the first and second arms are rigid and the clamp defines a C shape.

7. The device of claim 1, wherein the clamp is mounted to a surface and the firearm is immobilized adjacent the surface when engaged by the clamp and clamp closure.

8. The device of claim 1, wherein the base defines a base plane and the base portion defines a stopper plane generally orthogonal to the base plane.

9. The device of claim 1, wherein the base defines a base plane and the base portion defines a base portion plane generally coextensive with the base plane.

10. The device of claim 1, wherein the firearm defines a firearm longitudinal axis and the base portion defines a base portion plane that is generally orthogonal to the firearm longitudinal axis.

11. A device for preventing unauthorized use of a firearm, comprising:

a clamp, including:

a base defining a base plane and having first and second end portions, a first arm rigidly mounted to the base toward the first end portion and projecting orthogonally from the base plane, the first arm defining a longitudinal centerline parallel to the base plane and having a free end, a second arm rigidly mounted to the base toward the second end portion and projecting orthogonally from the base plane, the second arm defining a longitudinal centerline parallel to the base plane and having a free end, a base portion disposed on the base to physically prevent full cycling of the breech block when the clamp is engaged to the firearm, and a locking bar having first and second ends, the locking bar first end selectively engageable in a sequential fashion with either one of the first or second arm projecting ends and then with the other of the first or second arm projecting ends.

12. The device of claim 11, wherein the base and the base portion are coplanar.

13. The device of claim 11, wherein the first and second arm projecting ends each define an aperture; the locking bar second end includes an expanded portion and the locking bar first end defines an aperture, and the locking bar first end is inserted sequentially through the first and second arm apertures to engage the clamp and the locking bar expanded portion prevents movement of the locking bar second end through the first arm aperture.

14. The device of claim 11, wherein the firearm comprises a break open firearm including a barrel assembly having a chamber end; the breech block comprises a breech face and the base portion is positionable intermediate the breech block and chamber end of the barrel base.

15. A portable safety device for selective attachment to a firearm having a breech block and a chamber, comprising:

a clamp, including a base having opposing first and second end portions, a first arm mounted to the base at the first end portion and having an end projecting from the base, the first arm end defining an aperture, a second arm fixed to the base at the second end portion and having an end projecting from the base generally parallel with the first arm, the second arm defining an aperture;

a base portion disposed on the base and positionable within the firearm to physically prevent the breech block from dosing the chamber when the safety device is engaged with the firearm; and a locking member manually removable from the clamp and comprising a small end defining a locking aperture and a large end sized to prevent passage through the first arm aperture, the locking member selectively engageable with the clamp by a sliding motion of the small end through the first arm aperture and subsequently a sliding motion of the small end through the second arm aperture so that the locking aperture protrudes from the second arm aperture, the clamp and engaged locking member encircling the receiver, wherein the portable safety device and attached firearm can be readily carried by a user.

16. The safety device of claim 15 wherein the base portion is fixed to the clamp between the first arm end and the second arm end and projects in a direction generally similar to the arms.

17. The safety device of claim 15 wherein the locking member is rigid.

18. The safety device of claim 15 wherein the base portion is generally coplanar with the base.

19. The device of claim 11, wherein the first arm longitudinal centerline and the second arm longitudinal centerline are offset from each other.

20. The device of claim 15, wherein the firearm comprises a break open firearm; and the base portion is positionable intermediate the breech block and the chamber.

* * * * *

UNITED STATES PATENT AND TRADEMARK OFFICE

CERTIFICATE OF CORRECTION

PATENT NO. : 6,880,282 B1
DATED : April 19, 2005
INVENTOR(S) : Olsen

It is certified that error appears in the above-identified patent and that said Letters Patent is hereby corrected as shown below:

Column 9,
Line 45, after "firearm" delete "," and substitute -- ; --.

Column 10,
Line 25, delete "dosing" and substitute -- closing --.

Signed and Sealed this

Fourteenth Day of February, 2006

JON W. DUDAS
*Director of the United States Patent and Trademark Office*